US012221195B2

(12) United States Patent
Senoo et al.

(10) Patent No.: US 12,221,195 B2
(45) Date of Patent: Feb. 11, 2025

(54) FLUID MACHINE AND UNDERWATER VEHICLE

(71) Applicant: MITSUBISHI HEAVY INDUSTRIES, LTD., Tokyo (JP)

(72) Inventors: Shigeki Senoo, Tokyo (JP); Shinichi Isobe, Tokyo (JP); Wataru Yamada, Tokyo (JP); Takehiko Nishida, Tokyo (JP); Takuyoshi Yamada, Tokyo (JP); Kazuki Hosono, Tokyo (JP); Yoshitomo Noda, Tokyo (JP); Takuzo Shigihara, Tokyo (JP); Hiroki Takeda, Tokyo (JP); Yuichi Sekine, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 440 days.

(21) Appl. No.: 17/699,309

(22) Filed: Mar. 21, 2022

(65) Prior Publication Data

US 2022/0315181 A1 Oct. 6, 2022

(30) Foreign Application Priority Data

Mar. 31, 2021 (JP) ..... 2021-061816

(51) Int. Cl.
*B63G 8/08* (2006.01)
*B63H 1/16* (2006.01)
*B63H 21/17* (2006.01)

(52) U.S. Cl.
CPC ..... *B63G 8/08* (2013.01); *B63H 1/16* (2013.01); *B63H 21/17* (2013.01)

(58) Field of Classification Search
CPC .... B63H 1/16; B63H 21/17; B63H 2011/081; B63H 11/08
See application file for complete search history.

(56) References Cited

U.S. PATENT DOCUMENTS 5,286,116 A 2/1994 Garis, Jr.
5,607,329 A 3/1997 Cho et al.
(Continued)

FOREIGN PATENT DOCUMENTS

CN 211370815 8/2020
CN 112061357 12/2020
(Continued)

OTHER PUBLICATIONS

Renilson, Martin; "Submarine Hydrodynamics", Springer International Publishing, 2015, ISSN 2191-5318, pp. 120-126.
(Continued)

*Primary Examiner* — Anthony D Wiest
(74) *Attorney, Agent, or Firm* — Wenderoth, Lind & Ponack, L.L.P.

(57) ABSTRACT

A fluid machine includes: a shaft portion extending in an axis direction; a shroud provided to surround the shaft portion, and forming a flow path between the shroud and the shaft portion, the flow path having one side in the axis direction serving as an upstream side and another side in the axis direction serving as a downstream side; a propeller provided rotatably around the axis between the shaft portion and the shroud; a motor provided in the shroud and configured to rotationally drive the propeller; and a bearing apparatus provided only to the shaft portion, out of the shroud and the shaft portion, and rotationally supporting the propeller.

10 Claims, 7 Drawing Sheets

(56) References Cited

U.S. PATENT DOCUMENTS

| | | | | |
|---|---|---|---|---|
| 5,795,076 | A * | 8/1998 | Ball | F16C 33/108 384/307 |
| 8,074,592 | B2 | 12/2011 | Schroder | |
| 10,202,178 | B2 | 2/2019 | Himmelmann | |
| 10,414,477 | B2 | 9/2019 | Himmelmann | |
| 10,738,697 | B2 | 8/2020 | Himmelmann | |
| 11,152,555 | B2 | 10/2021 | Hiller | |
| 12,030,603 | B2 | 7/2024 | Lautrup | |
| 2009/0293795 | A1 | 12/2009 | Schroder | |
| 2014/0356199 | A1 | 12/2014 | Varis et al. | |
| 2014/0368074 | A1 | 12/2014 | Tangudi | |
| 2017/0002857 | A1 | 1/2017 | Guest, Jr. | |
| 2017/0104385 | A1 | 4/2017 | Salamon et al. | |

FOREIGN PATENT DOCUMENTS

| | | |
|---|---|---|
| CN | 112874746 | 6/2021 |
| EP | 0425723 | 5/1991 |
| EP | 0566788 | 10/1993 |
| FR | 2927605 | 8/2009 |
| GB | 2593022 | 9/2021 |
| JP | 5-310185 | 11/1993 |
| JP | 5-310186 | 11/1993 |
| JP | 3346589 B2 * | 11/2002 |
| JP | 2017-109726 | 6/2017 |
| JP | 2018-519487 | 7/2018 |

OTHER PUBLICATIONS

U.S. Office Action issued Oct. 28, 2024 in U.S. Appl. No. 17/700,724.

* cited by examiner

FLUID MACHINE AND UNDERWATER VEHICLE

CROSS-REFERENCE TO RELATED APPLICATIONS

This application claims the benefit of priority to Japanese Patent Application Number 2021-061816 filed on Mar. 31, 2021. The entire contents of the above-identified application are hereby incorporated by reference.

TECHNICAL FIELD

The present disclosure relates to a fluid machine and an underwater vehicle.

RELATED ART

For example, an outer periphery driving propulsion apparatus is described in U.S. Pat. No. 8,074,592 as an example of a fluid machine. The propulsion apparatus includes a shroud having a tubular shape formed around the axis, and propellers coaxially arranged on the inner side of the shroud.

The shroud accommodates a motor that rotationally drives the propeller. The motor includes a rotor provided on an outer circumference portion of the propeller and a stator surrounding the rotor from the outer circumference side. The motor and the stator each have a tubular shape with the outside surface and the inside surface being parallel with the axis. In the shroud, a bearing apparatus that rotatably supports the propeller is disposed next to the motor.

Such a motor implements outer periphery driving of the propeller, to make a fluid pumped in the axis direction inside the shroud.

SUMMARY

In the propulsion apparatus of U.S. Pat. No. 8,074,592, both the motor and the bearing apparatus are arranged in the shroud. For this reason, the shroud needs to have an increased size to accommodate the motor and the bearing apparatus.

In addition, since the circumferential speed is fast on the outer circumference side of the propeller, the load on the bearing apparatus is great. Therefore, a large bearing apparatus needs to be employed to withstand large load, which leads to a further increase in the size of the shroud that accommodates the bearing apparatus.

The present disclosure is made to solve the problem described above, and an object of the present disclosure is to provide a fluid machine and an underwater vehicle which can be downsized.

In order to solve the problem described above, a fluid machine according to the present disclosure includes: a shaft portion extending in an axis direction; a shroud provided to surround the shaft portion, and forming a flow path between the shroud and the shaft portion, the flow path having one side in the axis direction serving as an upstream side and another side in the axis direction serving as a downstream side; a propeller provided rotatably around the axis between the shaft portion and the shroud; a motor provided in the shroud and configured to rotationally drive the propeller; and a bearing apparatus provided only to the shaft portion, out of the shroud and the shaft portion, and rotationally supporting the propeller.

The present disclosure can provide a fluid machine and an underwater vehicle which can be downsized.

BRIEF DESCRIPTION OF DRAWINGS

The disclosure will be described with reference to the accompanying drawings, wherein like numbers reference like elements.

DESCRIPTION OF EMBODIMENTS

Overall Configuration of Underwater Vehicle

Figure 1:
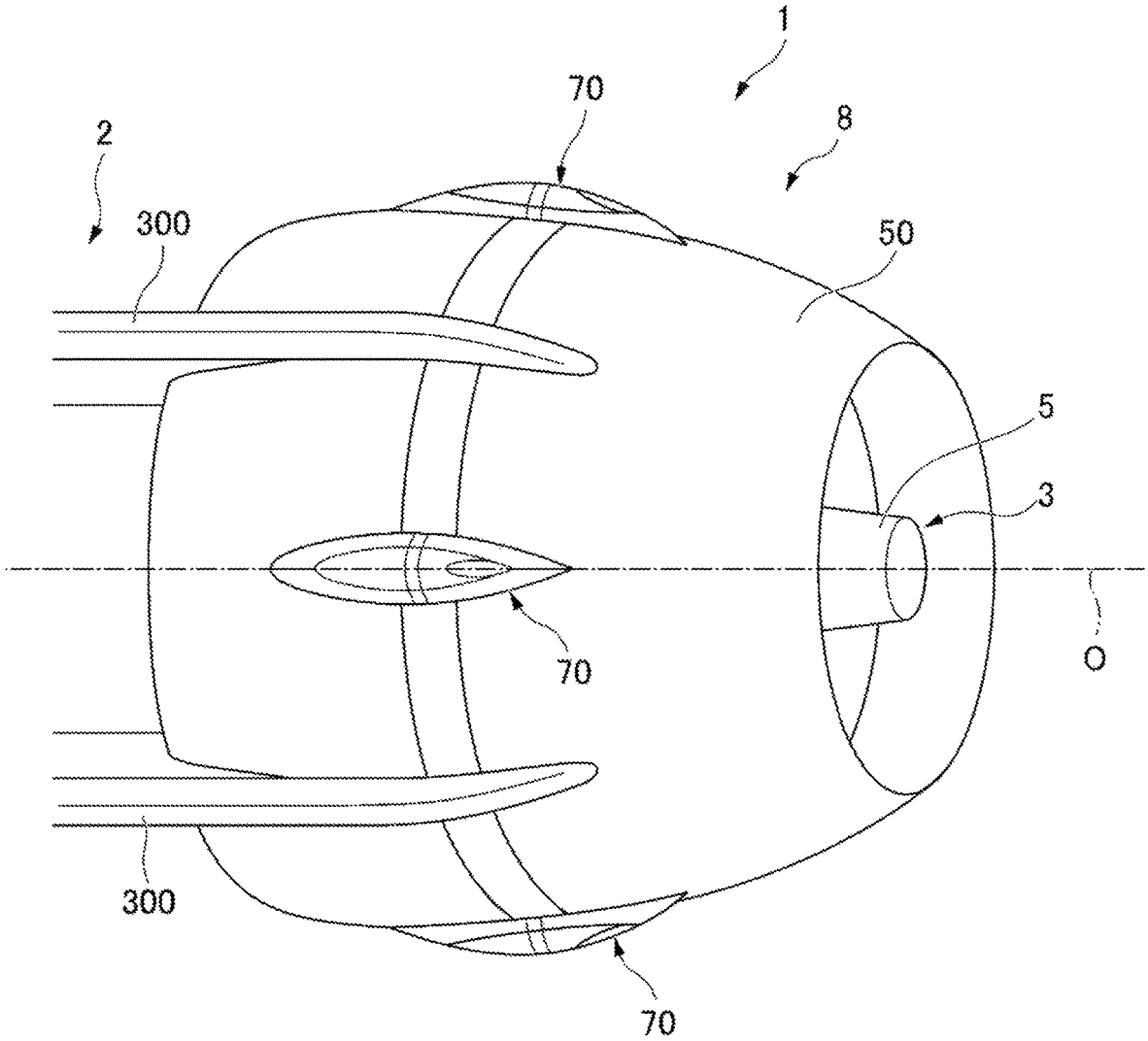
FIG. 1 is a perspective view of the stern of an underwater vehicle according to an embodiment of the present disclosure.
Figure 2:
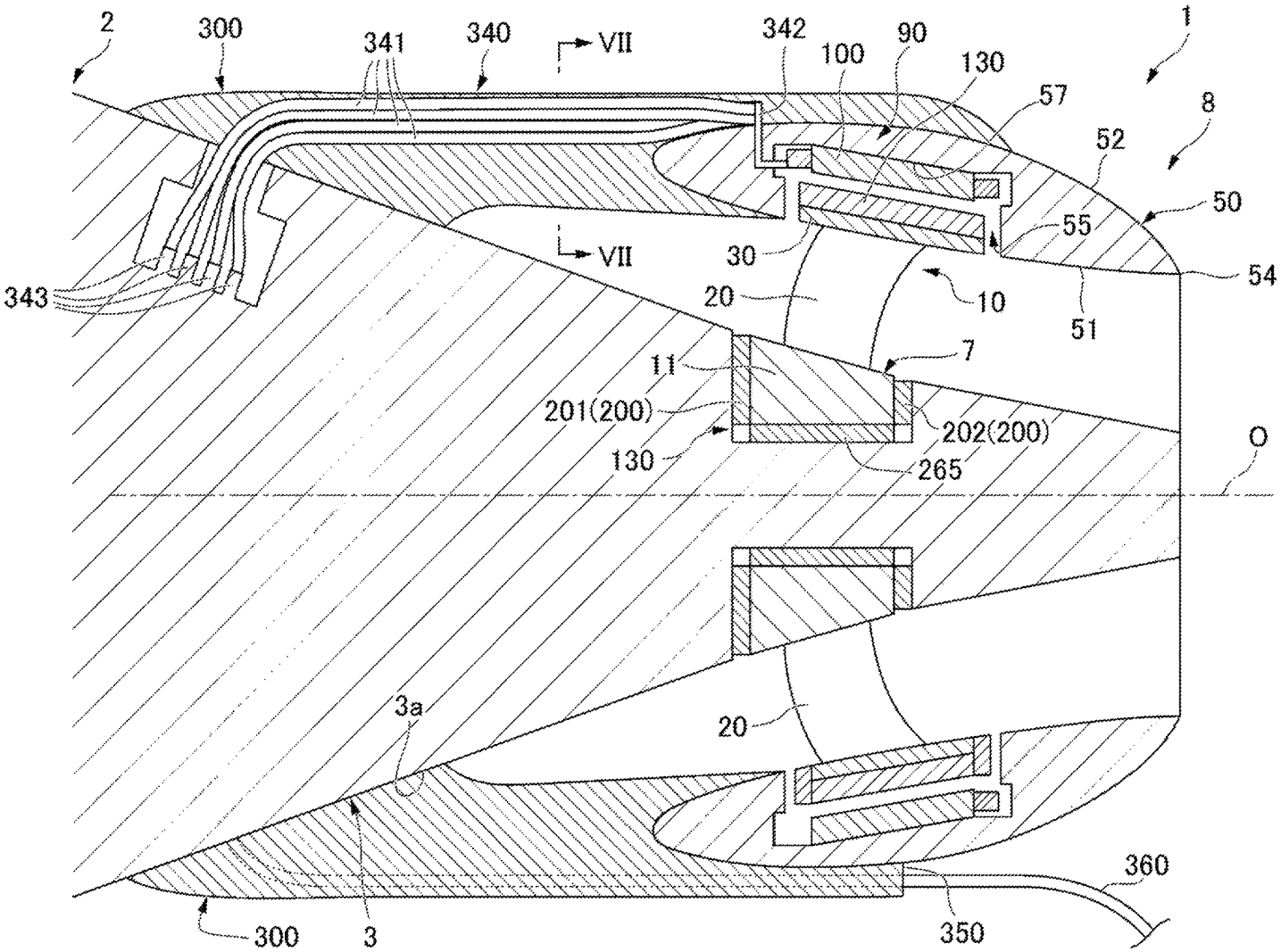
FIG. 2 is a vertical cross-sectional view of a propulsion apparatus according to the embodiment of the present disclosure.

The following describes in detail embodiments of the disclosure, with reference to the drawings. As illustrated in FIG. 1 and FIG. 2, an underwater vehicle 1 includes a vehicle body 2 and a propulsion apparatus 8.

Vehicle Body

The vehicle body 2 illustrated in FIG. 2 is formed by a pressure-resistant container that extends along an axis O. The vehicle body 2 accommodates various devices, power supply, communication equipment, sensors, and the like required for cruising underwater, for example.

Propulsion Apparatus

In a rear portion of the vehicle body 2, the propulsion apparatus 8 is provided integrally with the vehicle body 2. The propulsion apparatus 8 is an apparatus for propelling the underwater vehicle 1 underwater.

The propulsion apparatus 8 includes a shaft portion 3, a propeller 10, a shroud 50, a conical motor 90, a bearing apparatus 190, struts 300, a power cable 340, and an external cable 360.

Shaft Portion

As illustrated in FIG. 2, the shaft portion 3 is integrally provided in the rear portion of the vehicle body 2. The shaft portion 3 may be part of the vehicle body 2. The shaft portion 3 has a rod shape extending along the axis O. The shaft portion 3 of the present embodiment has a truncated cone shape having a diameter decreasing from one side (front side of the vehicle body 2, hereinafter referred to as "upstream side") toward the other side (rear side of the vehicle body 2, hereinafter referred to as "downstream side"), in the axis O direction. The radially outward facing surface of the shaft portion 3 is a shaft outside surface 3*a* forming a tapered shape having a diameter decreasing toward the other side in the axis O direction.

A receiving groove 7 formed on the shaft portion 3 is recessed inward in the radial direction from the shaft outside surface 3*a*, and annularly extends entirely over a circumferential direction.

Figure 3:
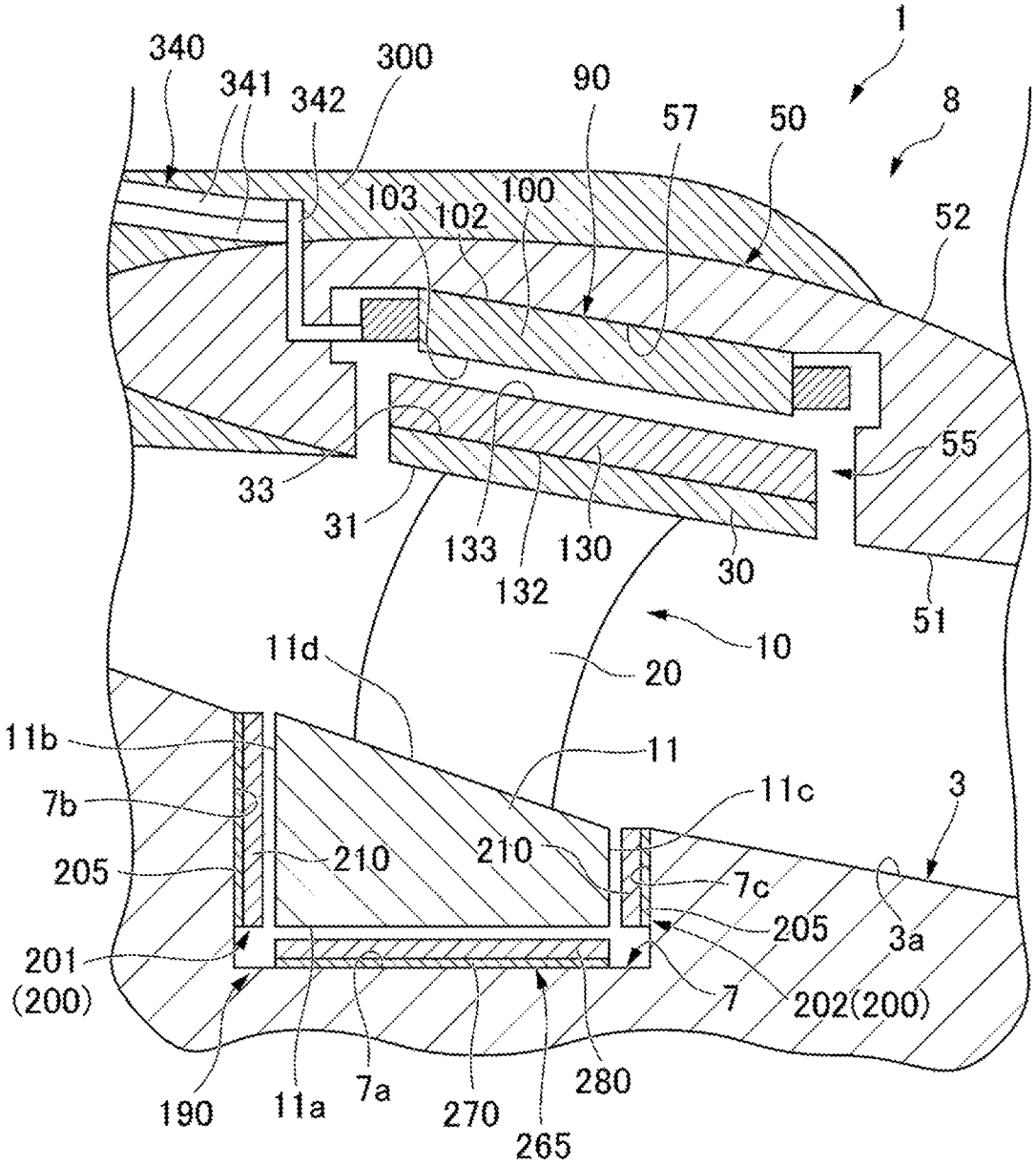
FIG. 3 is an enlarged view of a main part in FIG. 2.

Specifically, as illustrated in FIG. 3, a radially outward facing surface at the bottom of the receiving groove 7 is a groove bottom surface 7*a*. The groove bottom surface 7*a* forms a cylindrical surface shape around the axis O.

A surface, forming the receiving groove 7, on the upstream side is a groove upstream side surface 7*b*. The groove upstream side surface 7*b* has a planar shape orthogonal to the axis O, and faces the downstream side. The groove upstream side surface 7*b* annularly extends around the axis O.

A surface, forming the receiving groove 7, on the downstream side is a groove downstream side surface 7*c*. The groove downstream side surface 7*c* has a planar shape orthogonal to the axis O, and faces the upstream side. The groove downstream side surface 7*c* annularly extends around the axis O. The groove downstream side surface 7*c* is parallel to the groove upstream side surface 7*b*.

Propeller

As illustrated in FIG. 2 and FIG. 3, the propeller 10 is arranged on the outer circumference side of the shaft portion 3, and is relatively rotatable, around the axis O, with respect to the shaft portion 3. The propeller 10 includes an inner circumference ring 11, blades 20, and an outer circumference ring 30.

Inner Circumference Ring

The inner circumference ring 11 is a member having a shape of a ring around the axis O. The inner circumference ring 11 is received in the receiving groove 7.

As illustrated in FIG. 3, the inner circumference ring 11 includes a ring inner surface 11*a*, an upstream end surface lib, a downstream end surface 11*c*, and an outer circumference flow path surface 11*d*.

The ring inner surface 11*a* forms an inside surface of the inner circumference ring 11. The ring inner surface 11*a* forms a cylindrical surface shape facing the groove bottom surface 7*a* entirely over the circumferential direction. The inside diameter of the ring inner surface 11*a* is set to be larger than the outside diameter of the groove bottom surface 7*a*.

The upstream end surface 11*b* is a surface of the inner circumference ring 11 facing the upstream side, and is disposed on the downstream side of the groove upstream side surface 7*b* with a space interposed therebetween.

The downstream end surface 11*c* is a surface of the inner circumference ring 11 facing the downstream side, and is disposed on the upstream side of the groove downstream side surface 7*c* with a space interposed therebetween.

The outer circumference flow path surface 11*d* forms an outside surface of the inner circumference ring 11 facing outward in the radial direction. The outer circumference flow path surface 11*d* forms a tapered shape having a diameter decreasing toward the downstream side. The outer circumference flow path surface 11*d* extends to be continuous with the shaft outside surface 3*a*.

Blades

The blades 20 are provided to extend outward in the radial direction from the outer circumference flow path surface 11*d* of the inner circumference ring 11 of the propeller 10. A plurality of the blades 20 are provided with a space therebetween in the circumferential direction. The dimension of the blades 20 in the axis O direction is smaller than the dimension of the inner circumference ring 11 in the axis O direction.

The cross-sectional shape of the blades 20 intersecting in the radial direction is of a blade form. An edge portion of the blades 20 on the upstream side is a leading edge. An edge portion of the blades 20 on the downstream side is a trailing edge.

Outer Circumference Ring

As illustrated in FIG. 2 and FIG. 3, the outer circumference ring 30 is a member forming the outer circumference portion of the propeller 10, and forms a shape of a ring around the axis O. The outer circumference ring 30 of the propeller 10 establishes circumferential direction connection between the plurality of blades 20, arranged in the circumferential direction. The dimension of the outer circumference ring 30 of the propeller 10 in the axis O direction is larger than the dimension of the blades 20 in the axis O direction.

The outer circumference ring 30 includes an inner circumference flow path surface 31 and a tapered outer surface 33.

The inner circumference flow path surface 31 is a surface forming the inside surface of the outer circumference ring 30. The inner circumference flow path surface 31 of the outer circumference ring 30 of the propeller 10 is integrally connected to end portions of the plurality of blades 20, arranged in the circumferential direction, outward in the radial direction.

The tapered outer surface 33 is a surface forming the outside surface of the outer circumference ring 30. The tapered outer surface 33 forms a tapered shape having a diameter decreasing toward the downstream side. The tapered outer surface 33 has a uniform taper angle, and thus extends in the axis O direction with a uniform inclination angle relative to the axis O.

Shroud

As illustrated in FIG. 2 and FIG. 3, the shroud 50 is provided to surround the shaft portion 3 and the propeller 10 from the outer circumference side. The shroud 50 forms an annular shape around the axis O. The shroud 50 is disposed with a space from the outside surface of the shaft portion 3 in the radial direction. Thus, an annular flow path is formed entirely over the axis O direction between the shroud 50 and the shaft portion 3. The blades 20 of the propeller 10 are positioned in the flow path, and the outer circumference ring 30 of the propeller 10 is accommodated in the shroud 50. The shroud 50 is formed by a plurality of segments, split in the axis O direction. Each of the segments is fixed and integrated to each other by coupling portions 70 illustrated in FIG. 1.

The surface of the shroud 50 facing inward in the radial direction is a shroud inside surface 51. The shroud inside surface 51 faces the flow path. The radially outward facing surface of the shroud 50 is a shroud outside surface 52.

The cross-sectional shape of the shroud 50 of the present embodiment, including the axis O, is of a blade form. A connection portion between end portions of the shroud inside surface 51 and the shroud outside surface 52 on the upstream side is a shroud leading edge 53 annularly extending entirely over the circumferential direction. A connection portion between end portions of the shroud inside surface 51 and the shroud outside surface 52 on the downstream side is a shroud trailing edge 54 extending entirely over the circumferential direction and forming an annular shape. The position of the shroud trailing edge 54 in the axis O direction is the same as the position of the rear end of the shaft portion 3, that is, the position of the rear end of the shaft rear portion 5, in the axis O direction.

The shroud 50 has a shape with the diameter gradually decreasing toward the downstream side from the upstream side. In the present embodiment, a camber line, in the blade form cross section of the shroud 50, distances to which from the shroud inside surface 51 and the shroud outside surface 52 are the same, is gradually inclined inward in the radial direction toward the downstream side from the upstream side. Thus, the shroud trailing edge 54 is positioned more inward than the shroud leading edge 53 in the radial direction.

The shroud outside surface 52 has a diameter first increasing toward the downstream side in a portion around the shroud leading edge 53, and then smoothly decreasing toward the downstream side. The shroud outside surface 52 forms a convex curved shape protruding toward outward in the radial direction.

The shroud inside surface 51 has a diameter decreasing inward in the radial direction toward the downstream side, entirely over the axis O direction. The shroud inside surface 51 forms a convex curved shape protruding toward inward in the radial direction. The annular flow path formed between the shroud inside surface 51 and the shaft outside surface 3*a* of the shaft portion 3 is narrowed inward in the radial direction toward the downstream side. Thus, the cross-sectional area of the flow path decreases toward the downstream side.

A cavity 55 that is recessed outward in the radial direction from the shroud inside surface 51 is formed in the shroud 50. The outer circumference ring 30 of the propeller 10 is accommodated in the cavity 55.

The inner circumference flow path surface 31 of the outer circumference ring 30 of the propeller 10 extends to be continuous with the shroud inside surface 51 in the axis O direction. In other words, the inner circumference flow path surface 31 extends to form a part of the convex curved surface of the shroud inside surface 51.

On a surface in the cavity 55 facing inward in the radial direction, a tapered inner surface 57 having a bottom portion and having a diameter decreasing toward the downstream side with a uniform taper angle is formed. The tapered inner surface 57 is formed at a position in the axis O direction corresponding to the tapered outer surface 33 in the outer circumference ring 30 of the propeller 10.

Conical Motor

The conical motor rotationally drives the propeller 10 around the axis O. As illustrated in FIG. 2, the conical motor 90 is accommodated in the cavity 55 of the shroud 50. The conical motor 90 rotationally drives the propeller 10. The conical motor 90 has a conical stator 100 and a conical rotor 130.

Conical Stator

The conical stator 100 forms an annular shape around the axis O. The conical stator 100 forms a tapered shape having a diameter decreasing toward the downstream side. That is, a stator outside surface 102 that is the outside surface of the conical stator 100 and a stator inside surface 103 that is the inside surface of the conical stator 100 each form a tapered shape having a diameter decreasing toward the downstream side. The stator outside surface 102 and the stator inside surface 103 are parallel to each other in a cross-sectional view orthogonal to the axis O.

The taper angle of the stator outside surface 102 is the same as the taper angle of the tapered inner surface 57 within the cavity 55 of the shroud 50. Thus, the stator outside surface 102 is in contact with and fixed to the tapered inner surface 57 entirely over the axis direction and the circumferential direction.

Conical Rotor

The conical rotor 130 is provided to the outer circumference ring 30 of the propeller 10 inward in the radial direction of the conical stator 100.

The conical rotor 130 forms an annular shape around the axis O. The conical rotor 130 forms a tapered shape having a diameter decreasing toward the downstream side. That is, a rotor outside surface 133 that is the outside surface of the conical rotor 130 and a rotor inside surface 132 that is the inside surface of the conical rotor 130 each form a tapered shape having a diameter decreasing toward the downstream side. The rotor outside surface 133 and the rotor inside surface 132 are parallel to each other in a cross-sectional view orthogonal to the axis O.

The taper angle of the rotor inside surface 132 is the same as the taper angle of the tapered outer surface 33 in the outer circumference ring 30 of the propeller 10. Thus, the rotor inside surface 132 is in contact with the tapered outer surface 33 entirely over the axis direction and the circumferential direction and is integrally fixed. Thus, the conical rotor 130 and the propeller 10 rotate integrally around the axis O.

Furthermore, the rotor outside surface 133 and the stator inside surface 103 face each other in the radial direction, and their taper angles are the same. Thus, a uniform clearance is formed in the axis O direction and the circumferential direction, between the rotor outside surface 133 and the stator inside surface 103.

In the conical motor 90, when a coil provided in the conical stator 100 is energized, a rotating magnetic field is generated, and the conical rotor 130 rotates around the axis O due to this magnetic field.

Bearing Apparatus

The bearing apparatus 190 rotatably supports the propeller 10 around the axis O. The bearing apparatus 190 is provided only to the shaft portion 3, out of the shroud 50 and the shaft portion 3. The bearing apparatus 190 is provided in the receiving groove 7 formed in the shaft portion 3. The bearing apparatus 190 includes a first thrust bearing 201 and a second thrust bearing 202 as thrust bearings 200, and a radial bearing 265. The first thrust bearing 201, the second thrust bearing 202, and the radial bearing 265 support the inner circumference ring 11 of the propeller 10 in a non-contact manner with a water film as a lubricating film interposed therebetween.

The first thrust bearing 201 is provided on the groove upstream side surface 7*b* in the shaft portion 3 entirely over the circumferential direction. The first thrust bearing 201 faces the upstream end surface 11*b* of the inner circumference ring 11 in the axis O direction, with a clearance therebetween.

The second thrust bearing 202 is provided on the groove downstream side surface 7*c* in the shaft portion 3 entirely over the circumferential direction. The second thrust bearing 202 faces the downstream end surface 11*c* of the inner circumference ring 11 in the axis O direction, with a clearance therebetween.

The first thrust bearing 201 and the second thrust bearing 202, which are a pair of the thrust bearings 200, are provided so as to sandwich the inner circumference ring 11 from the axis O direction.

The following describes a detailed configuration of the thrust bearing 200 as the first thrust bearing 201 and the second thrust bearing 202 with reference to FIG. 3 to FIGS. 6A and 6B.

Thrust Bearing

Figure 4:
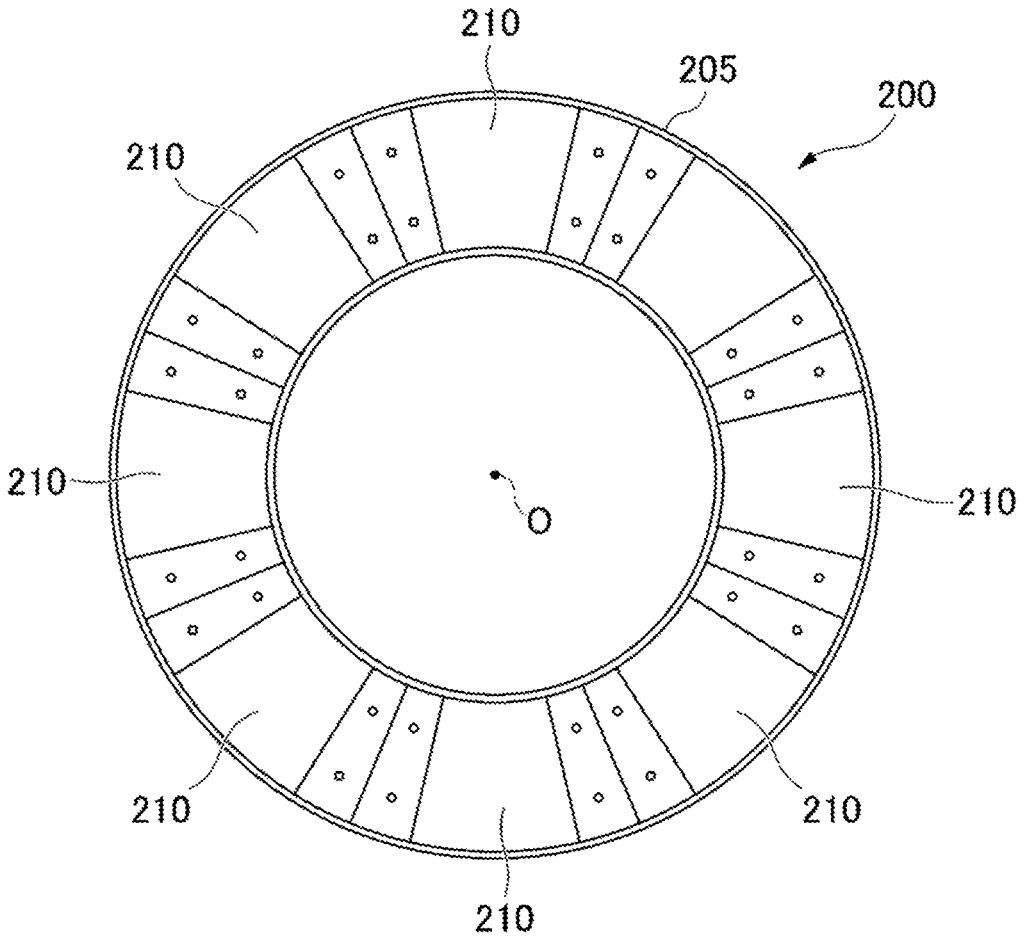
FIG. 4 is a view of a thrust bearing of the propulsion apparatus according to the embodiment of the present disclosure viewed in an axis direction.

As illustrated in FIG. 3 and FIG. 4, the thrust bearings 200 each have a disc 205, and thrust pads 210 as a bearing pad.

Disc

The disc 205 is a member forming a circular ring shape centering on the axis O and having a plate shape with a constant thickness in the axis O direction. The radial dimension of the disc 205 is constant entirely over the circumferential direction. The surface of the disc 205 on the side opposite to the inner circumference ring 11 is fixed to the shaft portion 3 (the groove upstream side surface 7*b*, the groove downstream side surface 7*c*) over the entire region in the circumferential direction.

The surface of the disc 205 facing the inner circumference ring 11 is a plane orthogonal to the axis O.

Thrust Pads

The thrust pads 210 are provided on a front surface that is a surface of the disc 205 on the inner circumference ring 11 side. As illustrated in FIG. 4, a plurality of the thrust pads 210 are provided in the circumferential direction on the front surface of the disc 205. The thrust pads 210 are provided to be laid on the front surface of the disc 205 in the circumferential direction. The plurality of thrust pads 210 as a whole form an annular shape surrounding the axis O.

Figure 5:
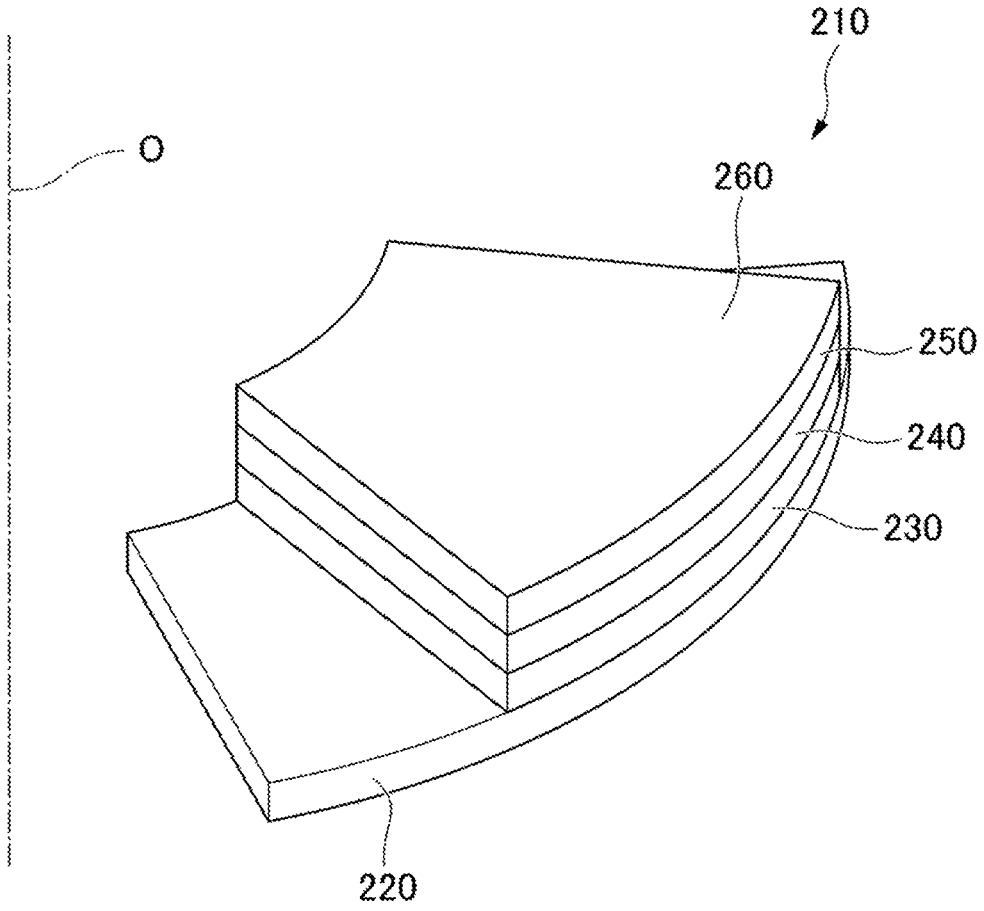
FIG. 5 is a perspective view of a bearing pad of the thrust bearing of the propulsion apparatus according to the embodiment of the present disclosure.

As illustrated in FIG. 5, each thrust pad 210 forms a four-layer structure in which a base layer 220, an elastic layer 230, a metal plate 240, and a sliding layer 250 are sequentially stacked from the shaft portion 3 side (the groove upstream side surface 7*b* side or the groove downstream side surface 7*c* side; lower side in FIG. 5) toward the inner circumference ring 11 (upper side in FIG. 5). The base layer 220, the elastic layer 230, the metal plate 240, and the sliding layer 250 each form a plate shape with the direction in which the inner circumference ring 11 and the thrust pad 210 face (axis O direction), that is, the stacking direction of the layers of the thrust pad 210 serving as a thickness direction. Hereinafter, the surface of each of these layers on the shaft portion 3 side is referred to as a back surface, and the surface on the inner circumference ring 11 side is referred to as a front surface.

Base Layer

The base layer 220 is made of a metal. The base layer 220 is made of stainless steel, for example. The base layer 220 is a reinforcing member that ensures the strength of the thrust pad 210.

The base layer 220 is arranged such that its back surface is in contact with the disc 205. The base layer 220 forms an arc shape obtained by splitting a circular ring into a plurality (eight in the present embodiment) of pieces in the circumferential direction as viewed in the stacking direction (axis O direction) of each layer. The end portions of the base layer 220 in the circumferential direction are in contact with each other between the thrust pads 210 adjacent to each other. The base layer 220 is integrally fixed to the disc 205 using bolts or the like, for example.

The front surface and the back surface of the base layer 220 are planes orthogonal to the axis O.

Elastic Layer

The elastic layer 230 is stacked on the front surface of the base layer 220. The elastic layer 230 is made of an elastically deformable material, that is, a material having a high elastic limit. The elastic layer 230 is made of, for example, various types of synthetic rubbers such as polybutadiene-based, nitrile-based, and chloroprene-based rubbers.

The front surface and the back surface of the elastic layer 230 are planes orthogonal to the axis O with no external force imparted to the thrust pad 210.

Metal Plate

The metal plate 240 is stacked on the front surface of the elastic layer 230. The metal plate 240 is provided to cover the entire front surface of the elastic layer 230. The metal plate 240 is made of a metal, like the base layer 220. The metal plate 240 is made of a metal having high corrosion resistance and rigidity such as a steel material including stainless metal, titanium, and the like, for example.

The front surface and the back surface of the metal plate 240 are planes orthogonal to the axis O.

Sliding Layer

The sliding layer 250 is stacked on the front surface of the metal plate 240. The sliding layer 250 is provided to cover the entire front surface of the metal plate 240. The front surface of the sliding layer 250 is a pad surface 260 facing the inner circumference ring 11 in the axis O direction with water interposed therebetween. In other words, the surface of the thrust pad 210 facing the inner circumference ring 11 is the pad surface 260.

The sliding layer 250 is made of a bearing material having a lower coefficient of friction than that of the other layers constituting the thrust pad 210. The bearing material may be any of a resin-based bearing material and a metal-based bearing material.

As the resin-based bearing material, for example, PEEK (polyetheretherketone) or PTFE (polytetrafluoroethylene) having a high lubricating property can be used. In addition, as the resin-based bearing material, various resins such as polyacetal, nylon, polyethylene, phenol resin, polyimide, polyphenylene sulfide, and polyamide-imide may be used, for example.

As the metal-based bearing material, various types of bearing alloys having lower rigidity but a lower coefficient of friction than those of the metal plate 240 can be used. For example, as the metal-based bearing material, various types of bearing alloys such as white metal, which is a tin-lead-based alloy as well as aluminum alloys and copper alloys can be used.

Overall Shape of Thrust Pad

The elastic layer 230, the metal plate 240, and the sliding layer 250 have the same shape as viewed in their stacking direction. The elastic layer 230, the metal plate 240, and the sliding layer 250 each form an arc shape obtained by splitting a circular ring into a plurality of pieces as viewed in the stacking direction. The circumferential dimension of the elastic layer 230, the metal plate 240, and the sliding layer 250 is smaller than the circumferential dimension of the base layer 220. Thus, portions on the front surface of the base layer 220 on both sides in the circumferential direction of the elastic layer 230, the metal plate 240, and the sliding layer 250 are exposed without being covered by the elastic layer 230, the metal plate 240, and the sliding layer 250. In these portions, water flows in the radial direction, and the thrust pad 210 is cooled by the water.

Shape of Pad Surface 260

Figure 6A:
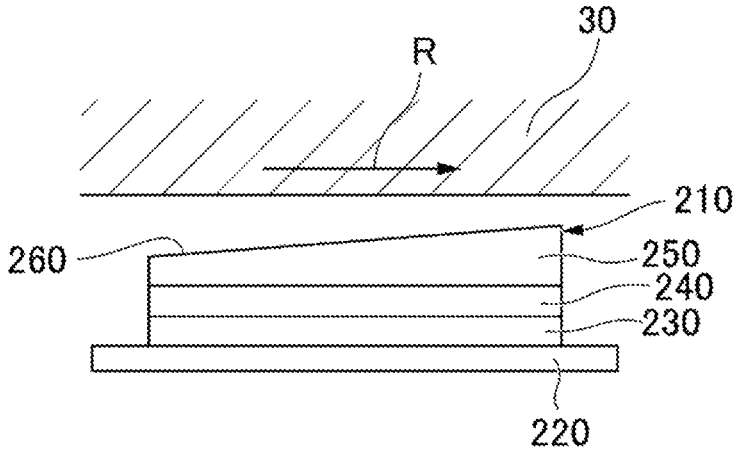
FIGS. 6A and 6B are side views illustrating modified aspects of the bearing pad of the thrust bearing according to the embodiment of the present disclosure, FIG. 6A illustrating an aspect before modification and FIG. 6B illustrating an aspect after modification.

Here, as illustrated in FIG. 6A, the front surface of the sliding layer 250, that is, the pad surface 260 extends toward the inner circumference ring 11 over the entire region, as the pad surface 260 approaches the front side in a rotational direction R of the inner circumference ring 11. That is, the height of the pad surface 260 from the disc 205 increases as the pad surface 260 approaches the front side in the rotational direction R in the circumferential direction. In other words, the pad surface 260 has an upward gradient as it approaches the front side in the rotational direction R.

As a result, an edge portion of the pad surface 260 on the rear side in the rotational direction R is furthest away from the inner circumference ring 11 in the axis O direction. An edge portion of the pad surface 260 on the front side in the rotational direction R is closest to the inner circumference ring 11 in the axis O direction.

Furthermore, the back surface of the sliding layer 250 is a plane orthogonal to the axis O. Thus, the thickness of the sliding layer 250 in the stacking direction gradually increases as the sliding layer 250 approaches the front side in the rotational direction R.

A wedge-shaped clearance is formed between the pad surface 260 and the inner circumference ring 11. The clearance makes the space gradually decreasing as it approaches the front side in the rotational direction R. The thrust pad 210 supports the inner circumference ring 11 from the axis O direction with a water film formed in this clearance interposed therebetween.

Radial Bearing

As illustrated in FIG. 3, the radial bearing 265 is provided on the groove bottom surface 7*a* of the receiving groove 7 entirely over the circumferential direction. The radial bearing 265 includes a tubular ring 270 and radial pads 280.

The tubular ring 270 is a member that forms a tubular shape extending around the axis O. The tubular ring 270 is coaxially fitted to the outer circumference side of the groove bottom surface 7*a* in the shaft portion 3.

A plurality of the radial pads 280 are provided to the outside surface of the tubular ring 270 entirely over the circumferential direction. The radial pads 280 have the same configuration as that of the thrust pads 210. That is, the base layer 220, the elastic layer 230, the metal plate 240, and the sliding layer 250 are stacked from the shaft portion 3 toward the ring inner surface 11*a* of the inner circumference ring 11. The pad surface 260 of the sliding layer 250 facing the ring inner surface 11*a* of the inner circumference ring 11 has a shape having an upward gradient so as to come close to the ring inner surface 11*a* as it approaches the front side in the rotational direction R of the inner circumference ring 11. The radial pad 280 supports the inner circumference ring 11 from inward in the radial direction, with a water film formed in the wedge-shaped clearance interposed therebetween, as the thrust pad 210 does.

Struts 300

As illustrated in FIG. 1 and FIG. 2, the struts 300 support the shroud 50 with respect to the shaft portion 3, by coupling the shroud 50 and the shaft portion 3 to each other. A plurality of the struts 300 are provided with a space therebetween in the circumferential direction, and extend from the shroud 50 in the axis O direction to be connected to the shaft portion 3 at an end portion on the upstream side. An end portion on the downstream side of each strut 300 is fixed to the shroud 50. More specifically, the end portion on the downstream side of the strut 300 is fixed to a region of the shroud 50 including a shroud leading edge 53 that spans the outer surface of the shroud 50 and the inner surface of the shroud 50.

Figure 7:
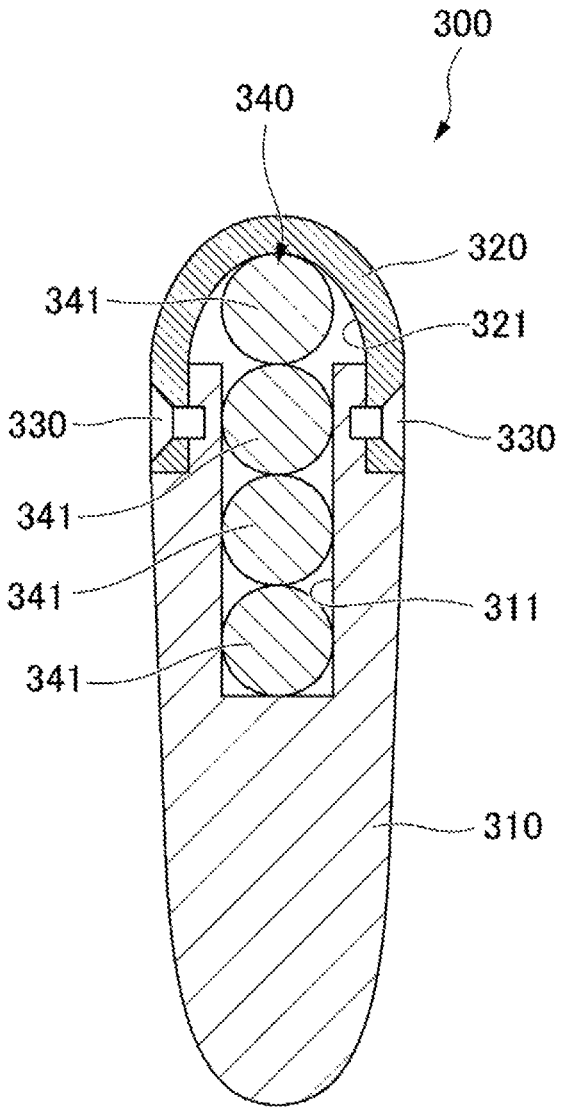
FIG. 7 is a cross-sectional view orthogonal to an axis of a strut, taken along line VII-VII in FIG. 2.

As illustrated in FIG. 7, the cross-sectional shape in the outer surface of the strut 300 orthogonal to the axis O is a flat shape with the longitudinal direction matching the radial direction (the up and down direction in FIG. 7) and the shorter direction matching the circumferential direction (the right and left direction in FIG. 7). Thus, the rotation of the propulsion of the underwater vehicle 1 is suppressed.

The strut 300 includes an inner circumference side member 310 and an outer circumference side member 320.

The inner circumference side member 310 is a member that constitutes a portion of the strut 300 inward in the radial direction. The inner circumference side member 310 forms a shape in which the cross-sectional shape orthogonal to the axis O extends in the radial direction. The inner circumference side member 310 extends in the axis O direction in the cross-sectional shape. The inner circumference side member 310 is provided with a receiving recessed groove 311 that is recessed inward in the radial direction from an end portion outward in the radial direction of the inner circumference side member 310. The receiving recessed groove 311 extends in the extension direction of the inner circumference side member 310, that is, in the axis O direction. The receiving recessed groove 311 does not reach a portion of the inner circumference side member 310 inward in the radial direction. That is, the receiving recessed groove 311 is formed so as to be biased outward in the radial direction of the inner circumference side member 310. Thus, the portion of the inner circumference side member 310 inward in the radial direction has a solid structure.

The outer circumference side member 320 is a member that constitutes a portion of the strut 300 outward in the radial direction. The outer circumference side member 320 forms a cover shape that covers the receiving recessed groove 311 of the inner circumference side member 310 from outward in the radial direction entirely over the extension direction of the strut 300. An inner wall surface of the outer circumference side member 320 is a receiving inner surface 321. A space for accommodating the power cable 340 is defined and formed by the receiving inner surface 321 of the outer circumference side member 320 and the receiving recessed groove 311 of the inner circumference side member 310 entirely over the extension direction of the strut 300.

The outer circumference side member 320 is attached to the inner circumference side member 310 using fixing screws 330 attached from both sides in the circumferential direction, with the inner circumference side member 310 covered from outward in the radial direction. The outer circumference side member 320 can be removed from the inner circumference side member 310 by removing the fixing screws 330. That is, the outer circumference side member 320 is removably attached to the inner circumference side member 310.

Power Cable

As illustrated in FIG. 2, the power cable 340 is a cable for supplying power to the conical motor 90. The power cable 340 has a plurality of wires 341 bundled. As illustrated in FIG. 7, the power cable 340 including the plurality of wires 341 is accommodated in the accommodating space formed by the receiving recessed groove 311 and the receiving inner surface 321 in the strut 300. The power cable 340 extends entirely over the extension direction of the strut 300. Since the accommodating space in the strut 300 is disposed to be biased outward in the radial direction, the power cable 340 accommodated in the strut 300 is also disposed to be biased outward in the radial direction.

As illustrated in FIG. 2, one end of the power cable 340 is inserted into the shaft portion 3 via a connection point between the strut 300 and the shaft portion 3, and is connected to a power source (not illustrated) via terminals 343. The other end (the end portion on the downstream side) of the power cable 340 is connected to the conical stator 100 of the conical motor 90 via a busbar 342 penetrating the shroud 50 at a connection point between the strut 300 and the shroud 50. In this manner, the power cable 340 is disposed in the strut 300 to extend in the extension direction of the strut 300, whereby the power source in the shaft portion 3 and the conical motor 90 in the shroud 50 are electrically connected.

The power cable 340 is arranged to extend within at least one strut 300, out of the plurality of struts 300. The power cable 340 may be disposed to extend within a plurality of struts 300 other than some struts 300, out of the plurality of struts 300. Power cables 340 may each extend in three struts 300, and the power cable 340 in each strut 300 may be any of a U-phase, a V-phase, and a W-phase of three-phase wiring.

External Cable

As illustrated in FIG. 2, the external cable 360 is a cable for connecting various devices within the shaft portion 3 (the vehicle body 2) and external devices provided separately from the underwater vehicle 1.

The external cable 360 extends across the shaft portion 3 and the end portion of the strut 300 on the downstream side via a connection point between the shaft portion 3 and the strut 300. A portion of the strut 300 at its end portion on the downstream side outward in the radial direction is a flat surface 350 having a planar shape orthogonal to the axis O direction. The external cable 360 extends outside the underwater vehicle 1 via the flat surface 350 of the strut 300 and is connected to external devices.

Operational Effects

The underwater vehicle 1 having the configuration described above can cruise underwater, with the propulsion apparatus 8 driven. Specifically, when the conical motor 90 in the cavity 55 of the shroud 50 is driven, the propeller 10 integrally fixed to the conical rotor 130 of the conical motor 90 rotates about the axis O. As a result, the water is pumped toward the downstream side by the blades 20 located in the flow path.

Then, thrust force toward the upstream side is generated at the propeller 10, as a reaction force produced by the pumping of the water. The thrust force is transferred to the shaft portion 3 from the inner circumference ring 11 of the propeller 10 via the first thrust bearing 201. As a result, the thrust force acts on the shaft portion 3 and the vehicle body 2 integrated therewith, whereby the underwater vehicle 1 is propelled.

In the present embodiment, the bearing apparatus 190 supporting the propeller 10 is provided to the shaft portion 3, while the conical motor 90 driving the propeller 10 is disposed in the shroud 50. That is, the propulsion apparatus 8 according to the present embodiment is configured to implement outer periphery driving and inner periphery support for the propeller 10.

Here, if both the conical motor 90 and the bearing apparatus 190 are provided in the shroud 50, the space for accommodating them needs to be formed inside the shroud 50. In view of this, there is a problem in that the shroud 50 itself is upsized, resulting in an increase in the drag against water, which decreases the propulsion efficiency.

In contrast, in the present embodiment, the conical motor 90 is disposed in the shroud 50, whereas the bearing apparatus 190 is provided only to the shaft portion 3, out of the shroud 50 and the shaft portion 3. As a result, the shroud 50 can be configured as a compact configuration, and a decrease in the propulsion efficiency can be avoided.

The circumferential speed of the propeller 10 is greater on the outer circumference side than the inner circumference side. For this reason, if the bearing apparatus 190 is provided on the outer circumference side, the load on the bearing apparatus 190 increases. In this case, the bearing apparatus 190 needs to be upsized in accordance with the increased load, leading to a further upsize of the shroud 50. By providing the bearing apparatus 190 to the shaft portion 3 as in the present embodiment, the load received by the bearing apparatus 190 can be reduced, whereby the bearing apparatus 190 can be downsized. As a result, a compact configuration of the propulsion apparatus 8 as a whole can be achieved.

Furthermore, in the present embodiment, slide bearings are employed as the first thrust bearing 201, the second thrust bearing 202, and the radial bearing 265 included in the bearing apparatus 190. With this configuration, the bearing apparatus 190 can be made into a more compact configuration than in a case where rolling bearings are employed, for example.

Water flowing between the inner circumference ring 11 and the first thrust bearing 201, the second thrust bearing 202, as well as the radial bearing 265 can be used as a lubricant. This configuration eliminates the need for an oil supply apparatus or the like, whereby the bearing apparatus 190 can be made into a simple configuration.

Furthermore, since the propeller 10 can be supported with a water film formed in the clearance between the inner circumference ring 11 and the first thrust bearing 201, the second thrust bearing 202, as well as the radial bearing 265, whereby the friction loss can be significantly reduced compared to a case where rolling bearings are used, for example.

In the thrust pad 210 and the radial pad 280, the elastic layer 230 is elastically deformed, whereby the sliding layer 250 is tilted. As a result, the alignment effect of the inner circumference ring 11 can be obtained by the thrust pad 210 and the radial pad 280.

Furthermore, the vibration transferred from the propeller 10 into the shaft portion 3 can be attenuated by the elastic layer 230. As a result, the vibration of the shaft portion 3 in association with the vibration of the propeller 10 can be suppressed, and transfer of the noise, caused by the vibration of the shaft portion 3, into the shaft portion 3 can be suppressed.

Here, in the present embodiment, as illustrated in FIG. 6A, the upward gradient is formed on the pad surface 260 of the thrust pad 210 toward the front side in the rotational direction R, and a water inlet side in the clearance is open. Thus, water that is guided by the inner circumference ring 11 can be easily drawn into the clearance.

Figure 6B:
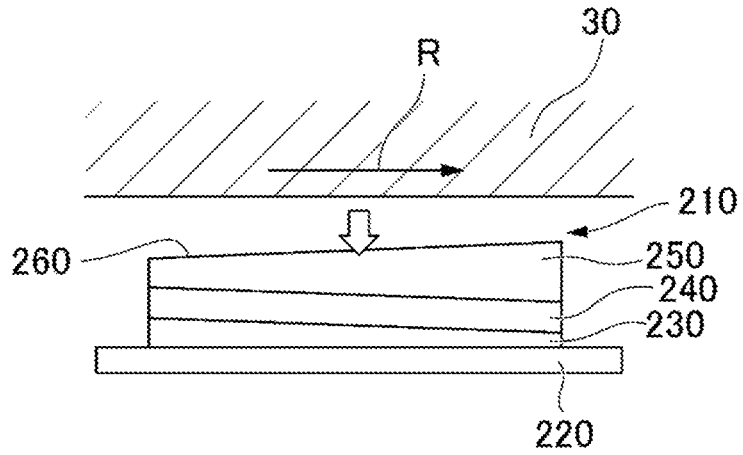

The water film is formed as a lubricating film in the clearance by the water drawn into the clearance. When the load is transferred to the thrust pad 210 via the water film, the load acts on the entire region of the pad surface 260 as surface pressure. As a result, as illustrated in FIG. 6B, the elastic layer 230 of the thrust pad 210 is greatly deformed in, in particular, the portion on the front side of the rotational direction R having a smaller clearance. As a result, the gradient of the pad surface 260 becomes lower.

When such a microgradient is formed, an appropriate wedge-shaped water film is formed in the clearance. Thus, there is no local load applied to only a portion of the pad surface 260, and the surface pressure is applied to the entire pad surface 260. As a result, the load capability of the thrust pad 210 can be improved. The radial pad 280 also exhibits similar effects.

The surface pressure transferred from the inner circumference ring 11 via the water film to the thrust pad 210 is particularly great in the center portion of the pad surface 260 in the rotational direction R. In contrast, in the present embodiment, the metal plate 240, having high rigidity, is disposed between the sliding layer 250 and the elastic layer 230, so that deformation of the elastic layer 230 recessed under the surface pressure can be suppressed.

That is, even if a great surface pressure is applied to the center portion of the sliding layer 250, the surface pressure is dispersed by the metal plate 240, provided on the back surface side and having high rigidity, to be imparted to the elastic layer 230. As a result, a large recess made in the elastic layer 230 can be avoided. Thus, the wedge shape of the clearance can be maintained, and high load capability can be maintained.

When the propulsion apparatus 8 is started, the output of the conical motor 90 is great, and the acceleration of the propeller 10 is great. As a result, the thrust load imparted to the first thrust bearing 201 on the upstream side increases. On the other hand, during deceleration or during non-stationary operation where acceleration and deceleration are repeated, a thrust load is imparted to the second thrust bearing 202 on the downstream side. In comparison of the thrust load, the thrust load imparted to the first thrust bearing 201 is great, and the thrust bearing 200 imparted to the second thrust bearing 202 is small.

In accordance with the intensity of the thrust load, by making a large thrust bearing 200 on the upstream side to which a great thrust load is imparted and a small thrust bearing 200 on the downstream side with a relatively less thrust load, the bearing apparatus 190 can be downsized while the thrust load is properly received.

Furthermore, in the present embodiment, the power cable 340 of the conical motor 90 is provided in the strut 300 supporting the shroud 50 on the shaft portion 3. This eliminates the need to separately provide a configuration for supplying power to the conical motor 90, whereby the entire propulsion apparatus 8 can be downsized.

Here, having a function to support the shroud 50, the strut 300 desirably has a high degree of strength to some extent. In the present embodiment, the power cable 340 is disposed at a position biased outward in the radial direction of the cross-sectional shape of the strut 300, and the portion inward in the radial direction is a solid structure. Thus, the strength of the strut 300 can be ensured while accommodating the power cable 340.

Furthermore, in the present embodiment, the strut 300 includes the inner circumference side member 310 and the outer circumference side member 320, and the outer circumference side member 320 is removably attachable to the inner circumference side member 310. By removing the outer circumference side member 320 from the inner circumference side member 310, the power cable 340 disposed in the strut 300 can be exposed. Thus, installation, removal, replacement, and maintenance of the power cable 340 can be easily performed.

Since the external cable 360 extends outside the strut 300 via the flat surface 350 formed at the end portion of the strut 300 on the downstream side, the drag in water due to the outlet portion of the external cable 360 from the strut 300 can be suppressed to minimum. This can maintain propulsion efficiency.

In the present embodiment, the conical motor with the conical stator 100 and the conical rotor 130 each having a diameter decreasing toward the downstream side is employed as the motor implementing outer periphery driving for the propeller. Thus, the shape of the conical motor 90 can be made in accordance with the shape of the shroud 50. Thus, the shape of the shroud 50 does not need to be upsized to conform to the configuration of the motor. This can make the shroud 50 have a further compact configuration.

Other Embodiments

The embodiment of the disclosure has been described above, but the disclosure is not limited thereto, and may be modified as appropriate within a range that does not deviate from the technical concept of the disclosure.

For example, while a configuration in which the propulsion apparatus 8 includes only one propeller 10 is provided in the embodiment, a plurality of propellers 10 may be provided in the axis O direction. In this case, it suffices if the bearing apparatus 190 of at least one propeller 10 is provided only to the shaft portion 3, out of the shroud 50 and the shaft portion 3.

In accordance with the plurality of propellers 10, a plurality of motors that drive these respective propellers 10 may be provided in the shroud 50.

In the embodiment, an example is described in which the conical motor 90 is employed as the motor that drives the propeller 10. However, this is not construed in a limiting sense. For example, a tubular motor with a stator and a rotor forming a tubular shape centering on an axis may be used.

In the embodiment, an example is described in which the thrust pad 210 has a four-layer structure of the base layer 220, the elastic layer 230, the metal plate 240, and the sliding layer 250. However, the metal plate 240 is not necessarily provided. Even in this case, the sliding layer 250, which supports the inner circumference ring 11 with the water film interposed therebetween, can reduce frictional drag, and the elastic layer 230 can provide the alignment effect and the vibration and sound isolation effect.

While an example is described in which the power cable 340 is disposed to be biased on the portion outward in the radial direction of the strut 300 in the embodiment, this is not construed in a limiting sense. The power cable 340 may be disposed to be biased inward in the radial direction of the strut 300, and the portion outward in the radial direction of the strut 300 may be a solid structure.

Furthermore, when a plurality of motors are provided in accordance with a plurality of propellers 10, the power cable 340 provided in each strut 300 may be configured to supply power to another motor. With this configuration, even if one strut 300 is broken and the power cable 340 in this strut 300 is damaged, power can be supplied to any of the motors through the power cable 340 in another strut 300, so that the motor can be driven.

Furthermore, in the embodiment, an example is described in which the fluid machine according to the disclosure is applied to the propulsion apparatus 8 of the underwater vehicle 1. However, the disclosure is not limited to this, and for example, the fluid machine may be applied to the propulsion apparatus 8 of a ship or the like that cruises on water.

The fluid machine according to the disclosure is not limited to the propulsion apparatus 8, and may be applied to other fluid machines used underwater such as a pump. Furthermore, the disclosure is not limited to a fluid machine that pumps water, and may be applied to a fluid machine that pumps other types of liquid such as oil.

Notes

The propulsion apparatus 8 (fluid machine) and the underwater vehicle 1 described in each of the embodiments are construed as follows, for example.

(1) A fluid machine according to a first aspect includes: a shaft portion 3 extending in an axis O direction; a shroud 50 provided to surround the shaft portion 3, and forming a flow path between the shroud 50 and the shaft portion 3, the flow path having one side in the axis O direction serving as an upstream side and another side in the axis O direction serving as a downstream side; a propeller 10 provided rotatably around the axis O between the shaft portion 3 and the shroud 50; a motor provided in the shroud 50 and configured to rotationally drive the propeller 10; and a bearing apparatus 190 provided only to the shaft portion 3, out of the shroud 50 and the shaft portion 3, and rotationally supporting the propeller 10.

In the present aspect, the bearing apparatus 190 supporting the propeller 10 is provided to the shaft portion 3, while the motor in the shroud 50 implements outer periphery driving of the propeller 10. Thus, the shroud 50 can have a compact configuration compared to a case where both the motor and the bearing apparatus 190 are provided to the shroud 50.

The propeller 10 has a low circumferential speed on the inner circumference side than on the outer circumference side. Thus, with the bearing apparatus 190 provided to the shaft portion 3, the load received by the bearing apparatus 190 is reduced as compared to a case where the bearing apparatus 190 is provided on the outer circumference side. As a result, the bearing apparatus 190 can be downsized, which makes it possible to achieve a compact configuration of the propulsion apparatus 8 as a whole.

(2) A fluid machine according to a second aspect is the fluid machine according to (1), in which the propeller 10 includes an inner circumference ring 11 provided on an outer circumference side of the shaft portion 3 with a clearance interposed therebetween, the bearing apparatus includes: a pair of thrust bearings 200 provided to the shaft portion 3 so as to sandwich the inner circumference ring 11 from both sides in the axis O direction, and a radial bearing 265 provided to the shaft portion 3 so as to face an inside surface of the inner circumference ring 11, and the thrust bearings 200 and the radial bearing 265 are slide bearings supporting the inner circumference ring 11 via a fluid film formed of a fluid entering the clearance.

By employing the slide bearings, a more compact configuration can be achieved than in a case where rolling bearings are used, for example. In addition, a fluid in an environment in which the fluid machine is placed can be used as a lubricant. This eliminates the need for an oil supply apparatus or the like.

Furthermore, the configuration to support the propeller 10 with the fluid film interposed therebetween can significantly reduce friction loss than in a case where rolling bearings are used, for example.

(3) A fluid machine according to a third aspect is the fluid machine according to (2), in which at least one of the thrust bearings 200 and the radial bearing 265 includes a plurality of bearing pads arranged in a circumferential direction, and the bearing pads each include an elastic layer 230 fixed to the shaft portion 3 and made of an elastic material that is elastically deformable, and a sliding layer 250 stacked on the elastic layer 230 so as to face the inner circumference ring 11 and made of a bearing material.

With this configuration, the elastic layer 230 is elastically deformed, whereby the sliding layer 250 can be tilted. As a result, the alignment effect of the inner circumference ring 11 can be obtained by the bearing pad.

Furthermore, the vibration and sound transferred from the propeller 10 into the shaft portion 3 can be attenuated by the elastic layer 230, that is, the vibration and sound isolation effect can be provided.

(4) A fluid machine according to a fourth aspect is the fluid machine according to (3), in which a pad surface 260 of the sliding layer 250 in the bearing pad extends toward the inner circumference ring 11, as the pad surface 260 approaches forward in a rotational direction R of the inner circumference ring 11.

The fluid is guided with the rotation of the inner circumference ring 11, whereby the fluid is drawn into the clearance between the inner circumference ring 11 and the pad surface 260. Here, in the present aspect, a gradient is formed on the pad surface 260, and a fluid inlet side of the clearance is open. Thus, the fluid can be easily drawn into the clearance.

As the elastic layer 230 is deformed in accordance with the surface pressure from the fluid drawn in this manner, the gradient of the pad surface 260 becomes lower. That is, with a microgradient surface formed on the pad surface 260, an appropriate wedge-shaped water film is formed in the clearance, and the load capability can be improved.

(5) A fluid machine according to a fifth aspect is the fluid machine according to (3) or (4), in which the bearing pad further includes a metal plate 240 stacked between the elastic layer 230 and the sliding layer 250 and having greater rigidity than rigidities of the elastic layer 230 and the sliding layer 250.

With this configuration, even if the surface pressure acts on the pad surface 260 via the fluid film, the metal plate 240, having high rigidity, is disposed between the sliding layer 250 and the elastic layer 230, so that deformation of the elastic layer 230 recessed can be suppressed. Thus, no large recess is caused in the bearing pad as a whole, and a decrease in the load capacity can be avoided.

(6) A fluid machine according to a sixth aspect is the fluid machine according to any one of (2) to (5), in which a total area of the pad surface 260, viewed in the axis O direction, of the thrust bearing 200 disposed on the upstream side out of the pair of thrust bearings 200 is larger than a total area of the pad surface 260, viewed in the axis O direction, of the thrust bearing 200 disposed on the downstream side.

When the propulsion apparatus 8 is started, the output of the motor is great and the acceleration of the propeller 10 is great, and thus a large thrust load is imparted to the thrust bearing 200 on the upstream side. On the other hand, during deceleration or during non-stationary operation where acceleration and deceleration are repeated, a thrust load is imparted to the thrust bearing 200 on the downstream side. In this manner, the load imparted to the thrust bearing 200 on the downstream side is less than the thrust load imparted to the thrust bearing 200 on the upstream side.

Thus, by making a large thrust bearing 200 on the upstream side to which a great thrust load is imparted and a small thrust bearing 200 on the downstream side with a relatively less thrust load, the bearing apparatus 190 can be downsized while the thrust load is properly received.

(7) A fluid machine according to a seventh aspect is the fluid machine according to any one of (1) to (6), further including: a plurality of struts 300 disposed with a space interposed therebetween in a circumferential direction and connecting the shroud 50 and the shaft portion 3, and a power cable 340 provided to extend across the shaft portion 3 and the shroud 50 in at least one of the struts 300 and configured to supply power to the motor in the shroud 50.

When the motor implements outer periphery driving of the propeller 10, it is important to determine what power supply system for the motor disposed in the shroud 50 is provided. In the present aspect, by providing the power cable 340 in the strut 300, which supports the shroud 50 on the shaft portion 3, it is possible to provide appropriate power supply to the motor without separately adding any member for the power supply system.

(8) A fluid machine according to an eighth aspect is the fluid machine according to (7), in which the struts 300 each extend from the shroud 50 toward the upstream side and are connected to the shaft portion 3, and have a cross-sectional shape orthogonal to the axis O of the strut 300 that has a flat shape with a longitudinal direction matching a radial direction, and the power cable 340 is disposed to be biased on one side in the radial direction in the strut 300. Having a function to support the shroud 50, the strut 300 desirably has a high degree of strength to some extent. In the present aspect, the power cable 340 is disposed on one side in the radial direction of the cross-sectional shape of the strut 300. Therefore, the portion on the other side in the radial direction of the strut 300 can have a solid structure, for example, and the strength of the strut 300 can be ensured.

(9) A fluid machine according to a ninth aspect is the fluid machine according to (8), in which the power cable 340 is disposed to be biased outward in the radial direction in the strut 300, the strut 300 includes: an inner circumference side member 310 that is a portion located inward in the radial direction, and an outer circumference side member 320 that is a portion located outward in the radial direction of the inner circumference side member 310 and is removable from the inner circumference side member 310, and the power cable 340 is exposed by removing the outer circumference side member 320 from the inner circumference side member 310.

Thus, installation, removal, replacement, and maintenance of the power cable 340 can be easily performed.

(10) A fluid machine according to a tenth aspect is the fluid machine according to any one of (7) to (9), in which a flat portion is formed on an end portion of at least some of the plurality of struts 300 on the downstream side, the flat portion having a planar shape orthogonal to the axis O and facing toward the downstream side, and the fluid machine further includes an external cable 360 connected to an external device and extending into and out of the strut 300 via the flat portion.

The outside diameter of the propulsion apparatus 8 as the fluid machine basically forms a flow line shape to minimize drag in water. For example, when the external cable 360 is connected to the outer surface of the shroud 50 or the shaft portion 3, the drag against water due to the external cable 360 increases.

In the present aspect, the flat portion is provided at the end portion of the strut 300 on the downstream side, and the external cable 360 is connected via this point, whereby an increase in the drag against water can be suppressed to minimum.

(11) A fluid machine according to an eleventh aspect is the fluid machine according to any one of (1) to (10), in which the motor is a conical motor 90 that has a diameter decreasing toward the downstream side.

By employing the conical motor 90 as the motor disposed in the shroud 50, the shape of the motor can be made in accordance with the shape of the shroud 50. Thus, the shape of the shroud 50 does not need to be upsized to conform to the configuration of the motor, whereby a compact configuration can be achieved.

(12) An underwater vehicle 1 according to a twelfth aspect includes: a vehicle body 2; and a propulsion apparatus 8 provided to the vehicle body 2, in which the propulsion apparatus 8 is the fluid machine according to any one of (1) to (11).

With such an underwater vehicle 1, the propulsion apparatus 8 can be downsized.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A fluid machine comprising:

a shaft portion extending in an axis direction;

a shroud provided to surround the shaft portion, and forming a flow path between the shroud and the shaft portion, the flow path having one side in the axis direction serving as an upstream side and another side in the axis direction serving as a downstream side;

a propeller provided rotatably around the axis between the shaft portion and the shroud;

a motor provided in the shroud and configured to rotationally drive the propeller; and a bearing apparatus provided only to the shaft portion, out of the shroud and the shaft portion, and rotationally supporting the propeller, wherein:

the propeller includes an inner circumference ring provided on an outer circumference side of the shaft portion with a clearance interposed therebetween;

the bearing apparatus includes a pair of thrust bearings provided to the shaft portion so as to sandwich the inner circumference ring from both sides in the axis direction, and a radial bearing provided to the shaft portion so as to face an inside surface of the inner circumference ring;

the thrust bearings and the radial bearing are slide bearings supporting the inner circumference ring via a fluid film formed of a fluid entering the clearance;

at least one of the thrust bearings and the radial bearing includes a plurality of bearing pads arranged in a circumferential direction, and the bearing pads each include an elastic layer fixed to the shaft portion and made of an elastic material that is elastically deformable, and a sliding layer stacked on the elastic layer so as to face the inner circumference ring with the clearance interposed therebetween, and made of a bearing material.

2. The fluid machine according to claim 1, wherein a pad surface of the sliding layer in the bearing pad extends toward the inner circumference ring, as the pad surface approaches forward in a rotational direction of the inner circumference ring.

3. The fluid machine according to claim 1, wherein the bearing pad further includes a metal plate stacked between the elastic layer and the sliding layer and having greater rigidity than rigidities of the elastic layer and the sliding layer.

4. The fluid machine according to claim 1, wherein a total area of the pad surface, viewed in the axis direction, of the thrust bearing disposed on the upstream side out of the pair of thrust bearings is larger than a total area of the pad surface, viewed in the axis direction, of the thrust bearing disposed on the downstream side.

5. The fluid machine according to claim 1, further comprising:

a plurality of struts disposed with a space interposed therebetween in a circumferential direction and connecting the shroud and the shaft portion, and a power cable provided to extend across the shaft portion and the shroud in at least one of the struts and configured to supply power to the motor in the shroud.

6. The fluid machine according to claim 5, wherein the struts each extend from the shroud toward the upstream side and are connected to the shaft portion, and have a cross-sectional shape orthogonal to the axis that has a flat shape with a longitudinal direction matching a radial direction, and the power cable is disposed to be biased on one side in the radial direction in the strut.

7. The fluid machine according to claim 6, wherein the power cable is disposed to be biased outward in the radial direction in the strut, the strut includes an inner circumference side member that is a portion located inward in the radial direction, and an outer circumference side member that is a portion located outward in the radial direction of the inner circumference side member and is removable from the inner circumference side member, and the power cable is exposed by removing the outer circumference side member from the inner circumference side member.

8. The fluid machine according to claim 5, wherein a flat portion is formed on an end portion of at least some of the plurality of struts on the downstream side, the flat portion having a planar shape orthogonal to the axis and facing toward the downstream side, and the fluid machine further comprises an external cable connected to an external device and extending into and out of the strut via the flat portion.

9. The fluid machine according to claim 1, wherein the motor is a conical motor that has a diameter decreasing toward the downstream side.

10. An underwater vehicle comprising:

a vehicle body; and a propulsion apparatus provided to the vehicle body, wherein the propulsion apparatus is the fluid machine according to claim 1.

* * * * *